US010458743B1

(12) United States Patent
Kempf et al.

(10) Patent No.: US 10,458,743 B1
(45) Date of Patent: Oct. 29, 2019

(54) CROSSBOW WITH BUILT IN COCKING DEVICE

(71) Applicants: James J. Kempf, Coralville, IA (US); Rex E. Isenhower, Stanwood, IA (US); Dorge O. Huang, Henry, IL (US)

(72) Inventors: James J. Kempf, Coralville, IA (US); Rex E. Isenhower, Stanwood, IA (US); Dorge O. Huang, Henry, IL (US)

( * ) Notice: Subject to any disclaimer, the term of this patent is extended or adjusted under 35 U.S.C. 154(b) by 0 days.

(21) Appl. No.: 15/995,229

(22) Filed: Jun. 1, 2018

Related U.S. Application Data

(60) Provisional application No. 62/517,437, filed on Jun. 9, 2017.

(51) Int. Cl.
*F41B 5/14* (2006.01)
*F41B 5/12* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123; F41B 5/1469
USPC ..... 124/25
See application file for complete search history.

(56) References Cited

U.S. PATENT DOCUMENTS 2,786,461 A * 3/1957 Pelsue, Jr. ..... F41B 5/12 124/25
4,294,222 A * 10/1981 Pelsue ..... F41B 5/12 124/25
4,719,897 A * 1/1988 Gaudreau ..... F41B 5/1469 124/25
5,220,906 A * 6/1993 Choma ..... F41B 5/12 124/25
5,433,186 A * 7/1995 Corwin ..... F41B 5/1449 124/1
5,823,172 A * 10/1998 Suggitt ..... F41B 5/12 124/25
6,095,128 A * 8/2000 Bednar ..... F41B 5/1469 124/25
6,286,496 B1 * 9/2001 Bednar ..... F41B 5/123 124/25
6,799,566 B1 * 10/2004 Malucelli ..... F41B 5/12 124/25
6,874,491 B2 * 4/2005 Bednar ..... F41B 5/10 124/25
6,913,007 B2 * 7/2005 Bednar ..... F41B 5/123 124/25
7,100,590 B2 * 9/2006 Chang ..... F41B 5/123 124/25
7,174,884 B2 2/2007 Kempf et al.
7,784,453 B1 * 8/2010 Yehle ..... F41B 5/12 124/25
7,814,894 B2 10/2010 Giroux
8,104,461 B2 * 1/2012 Kempf ..... F41B 5/12 124/25

(Continued)

*Primary Examiner* — Alexander R Niconovich
(74) *Attorney, Agent, or Firm* — Donald J. Ersler

(57) ABSTRACT

A crossbow with built in cocking device includes a manual crank and a built-in, removable motor gearbox assembly and power source. Rotational forces applied to a drive shaft rotate in a first direction, causing first and second string carriages to engage a bow string, moving the bow string towards a string catch. Once the string catch is latched to the bow string, a drive shaft is rotated in a second direction to move first and second string carriages to the a rest position.

15 Claims, 12 Drawing Sheets

(56) References Cited

U.S. PATENT DOCUMENTS

| | | | | |
|---|---|---|---|---|
| 8,240,299 | B2 * | 8/2012 | Kronengold | F41A 11/02 124/25 |
| 8,375,928 | B1 * | 2/2013 | Bednar | F41B 5/1469 124/25 |
| 8,443,790 | B2 * | 5/2013 | Pestrue | F41B 5/1469 124/25 |
| 8,452,631 | B2 | 5/2013 | Doss et al. | |
| 8,453,631 | B1 | 6/2013 | Kronengold et al. | |
| 8,950,385 | B1 * | 2/2015 | Khoshnood | F41B 5/1469 124/1 |
| 9,341,432 | B1 * | 5/2016 | Wohleb | F16H 25/20 |
| 9,341,434 | B2 * | 5/2016 | McPherson | F41B 5/123 |
| 9,494,380 | B1 * | 11/2016 | Yehle | F41B 5/12 |
| 9,494,381 | B1 * | 11/2016 | Jeske | F41B 5/12 |
| 9,714,808 | B2 * | 7/2017 | Carroll, Jr. | F41B 5/1469 |
| 9,958,232 | B1 * | 5/2018 | Egerdee | F41B 5/1403 |
| 2016/0273870 | A1 * | 9/2016 | Pulkrabek | F41B 5/1469 |

* cited by examiner

CROSSBOW WITH BUILT IN COCKING DEVICE

CROSS-REFERENCES TO RELATED APPLICATIONS

This is a utility patent application, which claims the benefit of provisional application No. 62/517,437 filed on Jun. 9, 2017.

BACKGROUND OF THE INVENTION

Field of the Invention

The present invention relates generally to archery, and more specifically to a crossbow with built-in cocking device, which allows an archer to more easily cock a crossbow, and de-cock a crossbow.

Discussion of the Prior Art

U.S. Pat. No. 7,174,884 to Kempf et al. discloses a crossbow with built-in cocking mechanism, having a string retainer coupled to a flexible member and spool. U.S. Pat. No. 8,140,461 discloses a crossbow with built-in cocking mechanism, having a means for engaging a string coupled to a flexible member and spool. U.S. Pat. Nos. 8,240,299 and 8,452,631 to Kronengold et al. discloses a crossbow with built-in cocking device having a movable string release. U.S. Pat. No. 7,814,984 to Giroux discloses a anti dry-fire device for crossbows. U.S. Pat. No. 7,784,453 to Yehle discloses a crossbow with built-in cocking mechanism for a crossbow, having a string release coupled to a chain. Though all of these methods of cocking a crossbow are functional, they require the use of flexible chords or chains that may stretch or break, causing damage to the crossbow, or injury to the user. Therefore, the manner by which they operate is not acceptable for smooth operation, function, and longevity.

Accordingly, there is a need for a crossbow with built-in cocking device, which has no flexible chords or chains; may be manually or electrically operated; and uses a proven linear motion type mechanism to cock and de-cock a crossbow.

SUMMARY OF THE INVENTION

The present invention provides a crossbow with built-in cocking device, which includes a built in manual cocking mechanism for a crossbow that may also be utilized with an optional built in, removable motor gearbox assembly and power source. A crossbow with built-in cocking includes a riser, a barrel or frame, at least two bow limbs, preferably two cams, a bow string, at least one cable, a trigger housing, a string catch, a stock, at least one string carriage but preferably two carriages, and at least one linear motion shaft called a carriage shaft but preferably two carriage shafts. The stock is attached to one end of the barrel. The riser is attached to the barrel in above or in front of the stock. The bow limbs extend from opposing ends of the riser. Each bow limb is terminated with one of the two cams. The bow string is retained on the two cams. The at least one cable is functionally coupled with the limbs and the cams. The trigger housing is contained within the stock, frame, or barrel. The at least one carriage shaft has a first end and a second end, is integrated with the barrel or frame, and is operably coupled with the at least one carriage. The said first end of said carriage shaft is rotate-ably retained with the forward end of the crossbow, and the second end of said carriage shaft has a fixed carriage shaft gear, and is rotate-ably retained adjacent to the trigger housing.

A hand crank main gear mates to a drive shaft pinion gear. The drive shaft is in-turn connected to a main drive shaft drive gear on a first end, and a motor gearbox assembly coupling at a second end. The main drive shaft drive gear is coupled to the carriage shaft drive gears.

The motor gearbox assembly may or may not have a clutch assembly, whereby the rotational force applied by the said motor gearbox assembly reaches a predetermined amount of force, the rotation of the main drive shaft ceases. A switch may be provided as to start, stop, and reverse the direction of rotation of the motor gearbox assembly, as well as switches and or circuits that may control operation of the motor gear set.

The carriages are set at the front end of the bow when at rest, or when the bow is cocked and ready to shoot. When in use, the hand crank is turned a first direction, causing the carriages to engage the string, and move the string towards the string catch. Once the string catch is latched to the string, the hand crank is rotated in a second direction until the carriage is in the at-rest position.

Another unique feature of the disclosed invention is the optional built-in, removable electric motor gearbox assembly that may take the place of the hand crank, without removal of the crank assembly.

Accordingly, it is an object of the present invention to provide a crossbow with built-in cocking device, which has no flexible chords or chains.

It is a further object of the present invention to provide a crossbow with built-in cocking device, which may be manually or electrically operated;

Finally, it is another object of the present invention to provide a crossbow with built-in cocking device, which uses a proven linear motion type mechanism to cock and de-cock a crossbow.

These and additional objects, advantages, features and benefits of the present invention will become apparent from the following specification.

DETAILED DESCRIPTION OF THE PREFERRED EMBODIMENTS

Figure 6A:
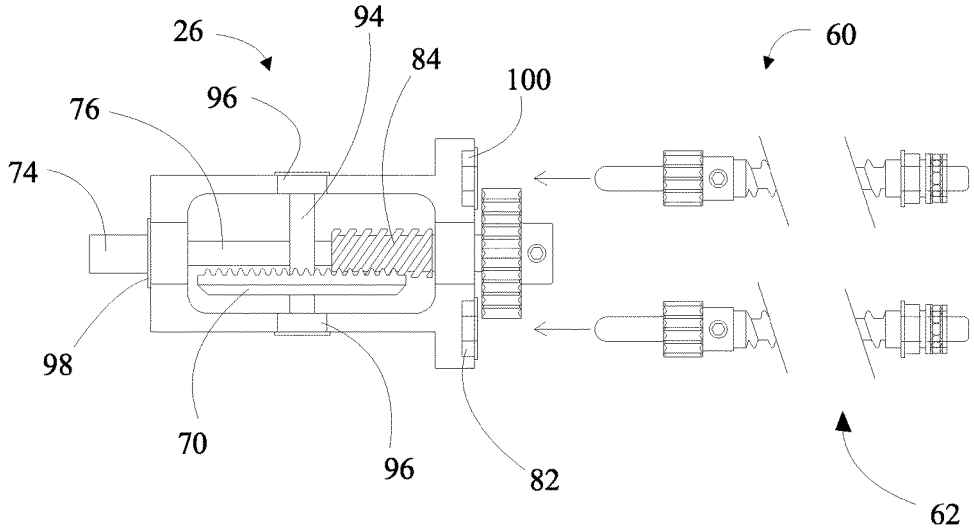
FIG. 6A is a top view of a crank assembly of a crossbow with built in cocking device in accordance with the present invention.
Figure 6B:
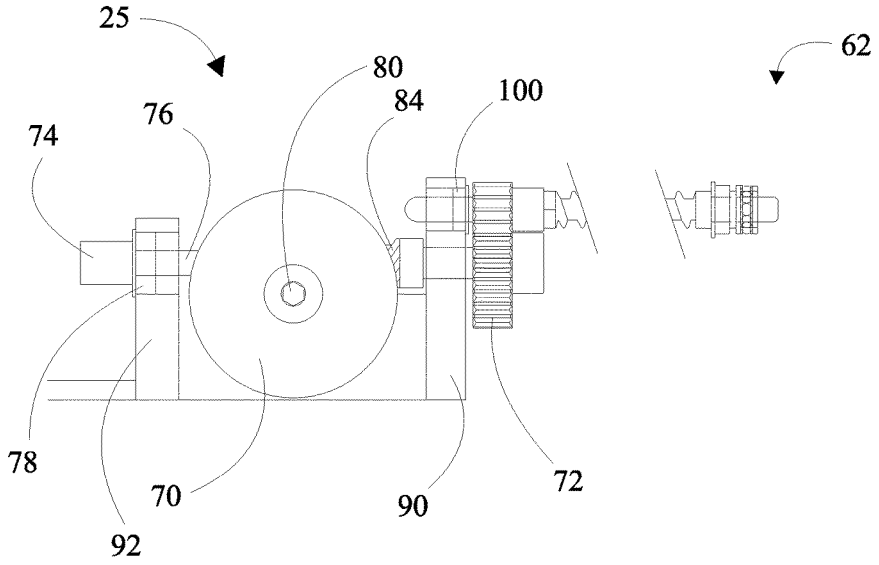
FIG. 6B is a side view of a crank assembly of a crossbow with built in cocking device the present invention

With reference now to the drawings, and particularly to FIGS. 1-4A, there is shown a preferred embodiment of a crossbow with built-in cocking device (crossbow with cocking) 1. The crossbow with cocking 1 includes a riser 10, a barrel 22, a first bow limb 14 and a second bow limb 16, a first cam 18 and a second cam 20, a bow string 40, a stock 34, a butt stock 32, and a trigger housing 24. Crossbow may be regular style crossbow or a reverse style crossbow. The first and second bow limbs 14 and 16 extend from opposing ends of the riser 10. The stock 34 extends from below the trigger housing 24 forward along the frame or barrel 22. The riser 10 is attached to the frame or barrel 22. The proximal ends of the first limb 14 and second limb 16 are joined with opposing ends of the riser 10. A first cam 18 is rotatably coupled with the distal end of the first limb 14, and the second cam 20 is rotatably coupled with the distal end of said second limb 16. A first end of the bow string 40 is retained on the first cam 40, and a second end of said bowstring 40 is retained on said second cam 20. The trigger housing 24 is contained within the frame or barrel 22. A crank handle 108 is operably coupled to a hand crank receiver 80, as illustrated in FIG. 6B.

Figure 1:
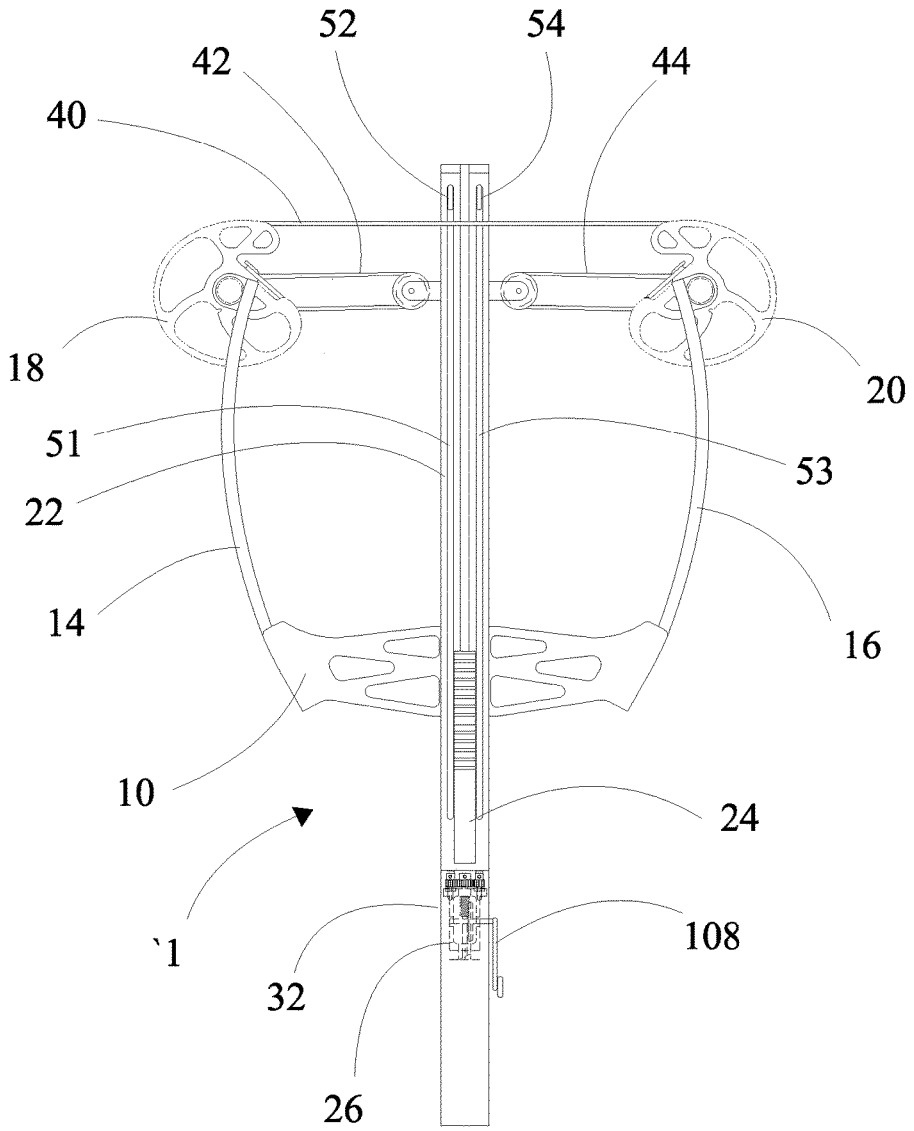
FIG. 1 is a top view of a crossbow with built in crank cocking device in a rest position in accordance with the present invention.
Figure 1A:
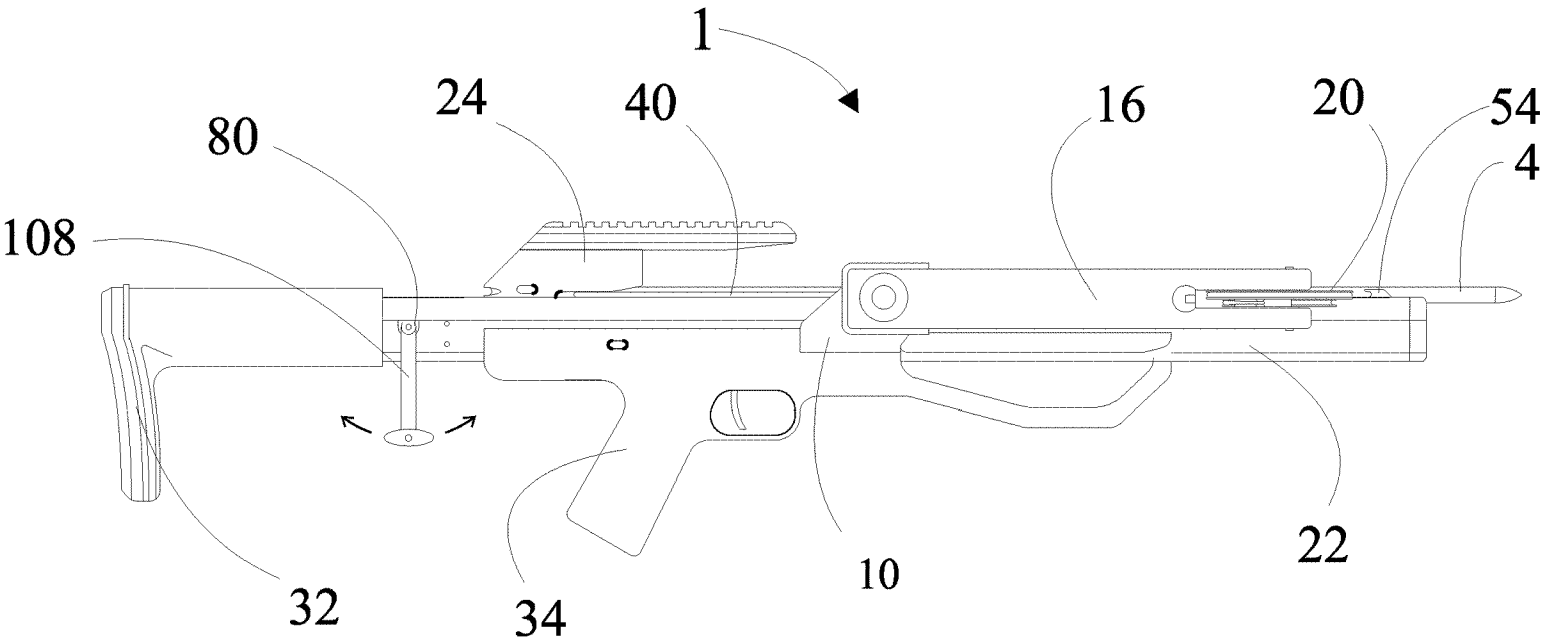
FIG. 1A is a side view of a crossbow with built in crank cocking device in a rest position in accordance with the present invention.
Figure 1B:
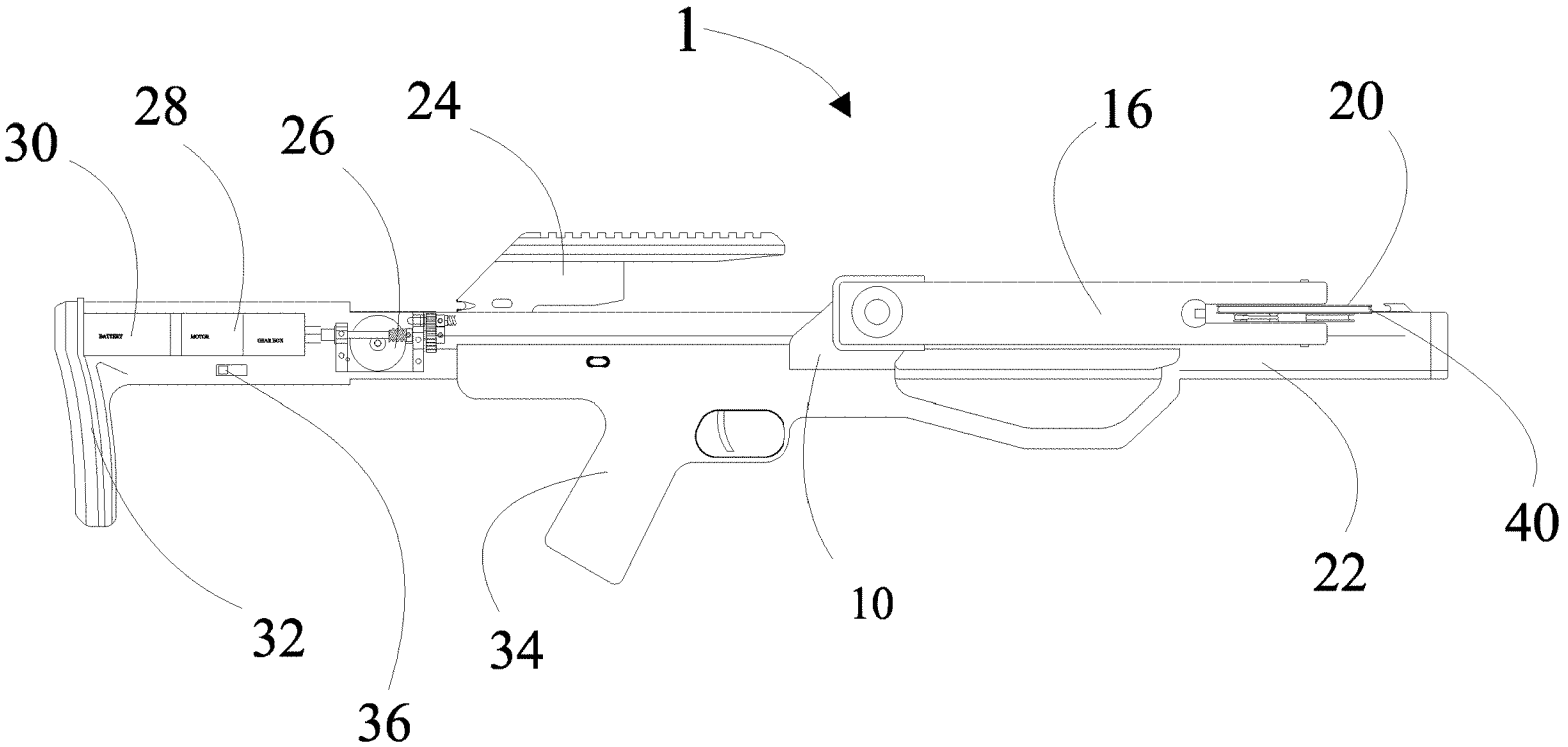
FIG. 1B is a side view of a crossbow with built in crank cocking device with an optional motor gearbox assembly and power source in a rest position in accordance with the present invention.
Figure 1C:
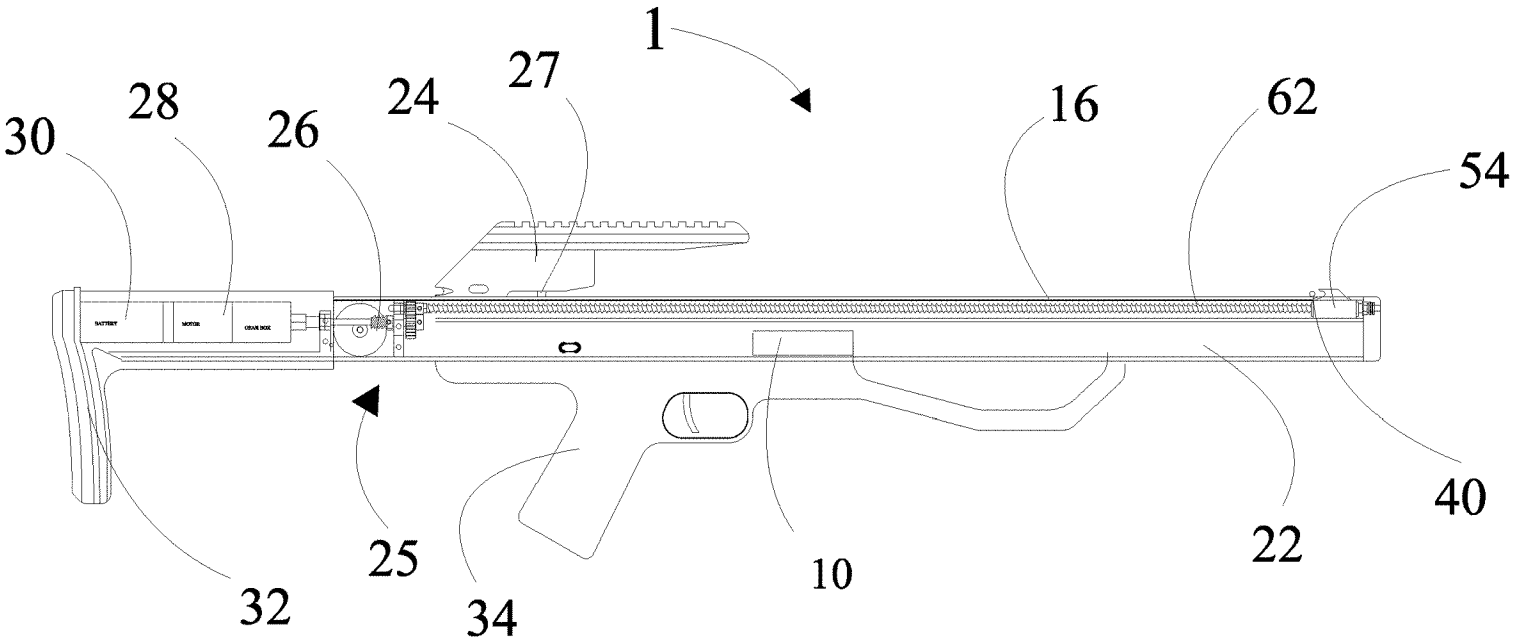
FIG. 1C is a partial cut-away side view of a crossbow with built in crank cocking device with an optional motor gearbox assembly and power source in a rest position, a carriage shaft assembly and crank assembly are illustrated in accordance with the present invention.
Figure 2:
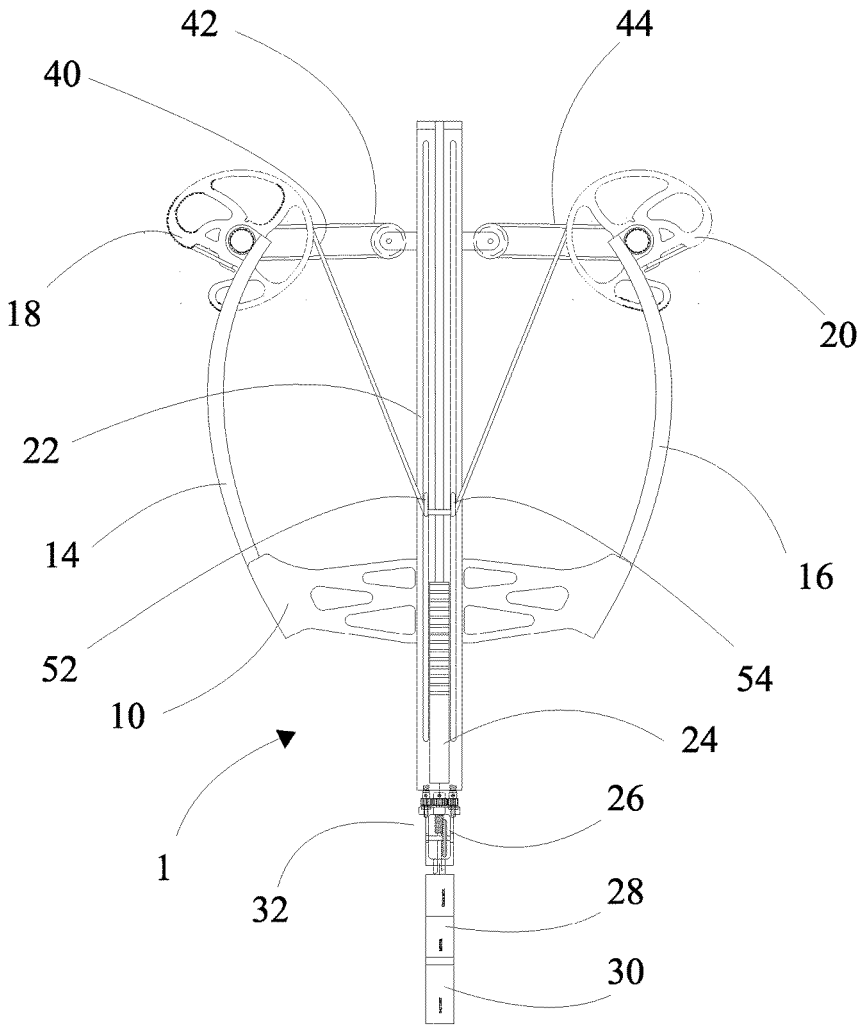
FIG. 2 is a top view of a crossbow with built in cocking device and optional motor gearbox assembly, in a half-cocked position in accordance with the present invention.
Figure 2A:
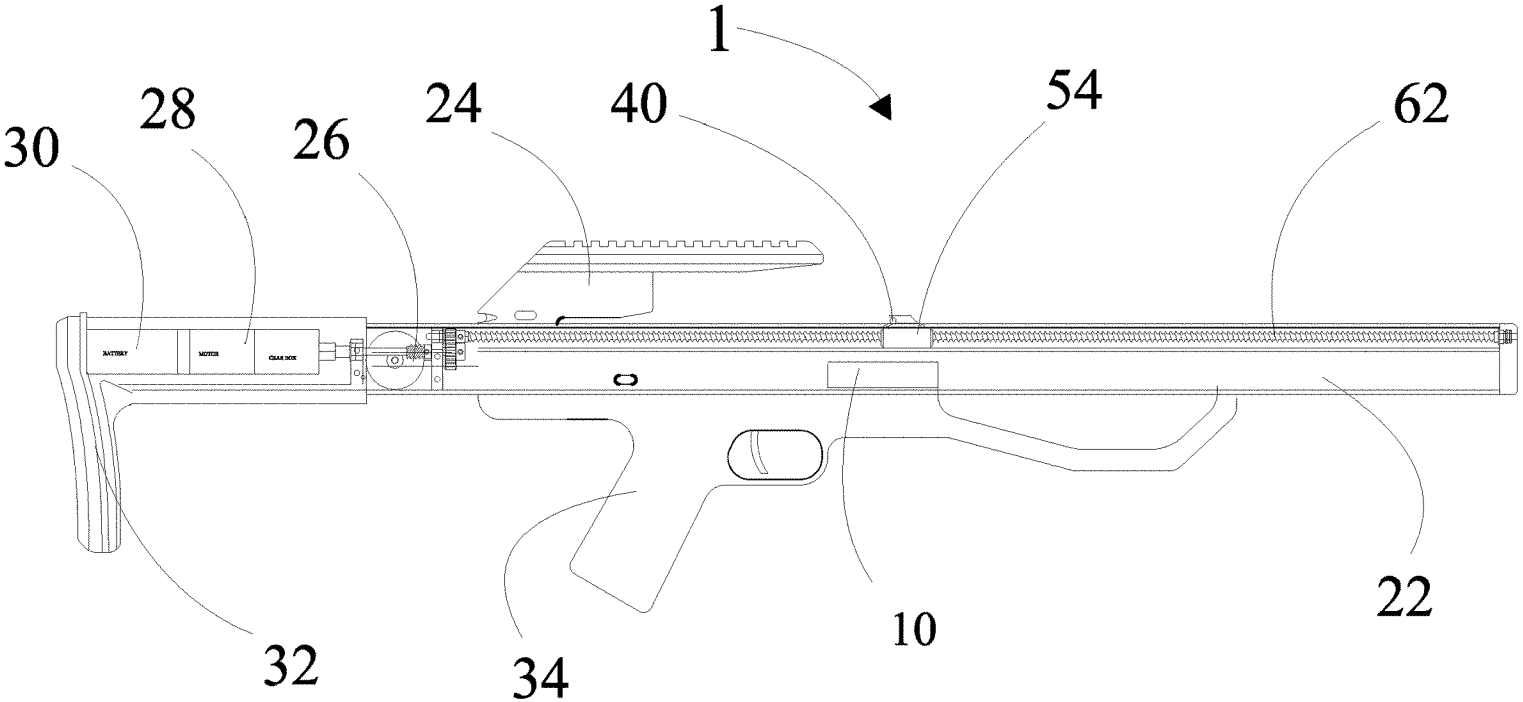
FIG. 2A is a partial cut-away side view of a crossbow with built in cocking device and optional motor gearbox assembly in a half-cocked position in accordance with the present invention.
Figure 3:
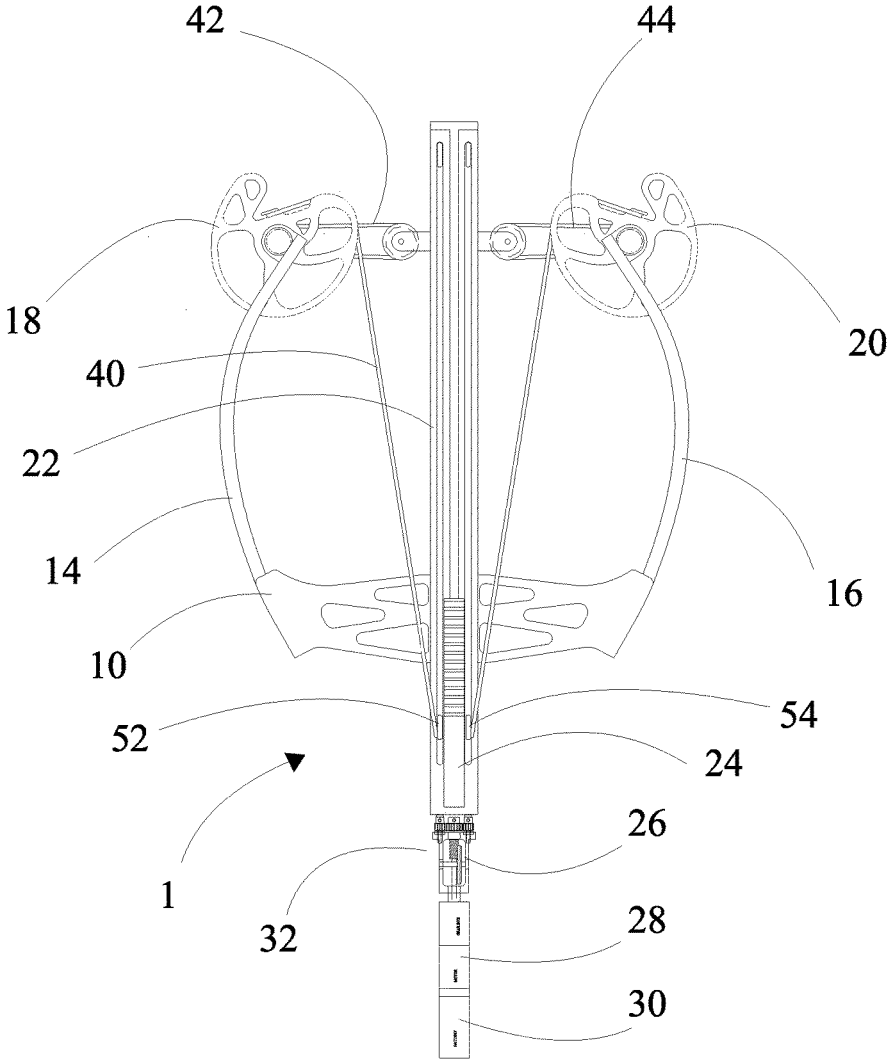
FIG. 3 is a top view of a crossbow with built in cocking device with a built in motor gearbox assembly in a just-cocked position in accordance with the present invention.
Figure 3A:
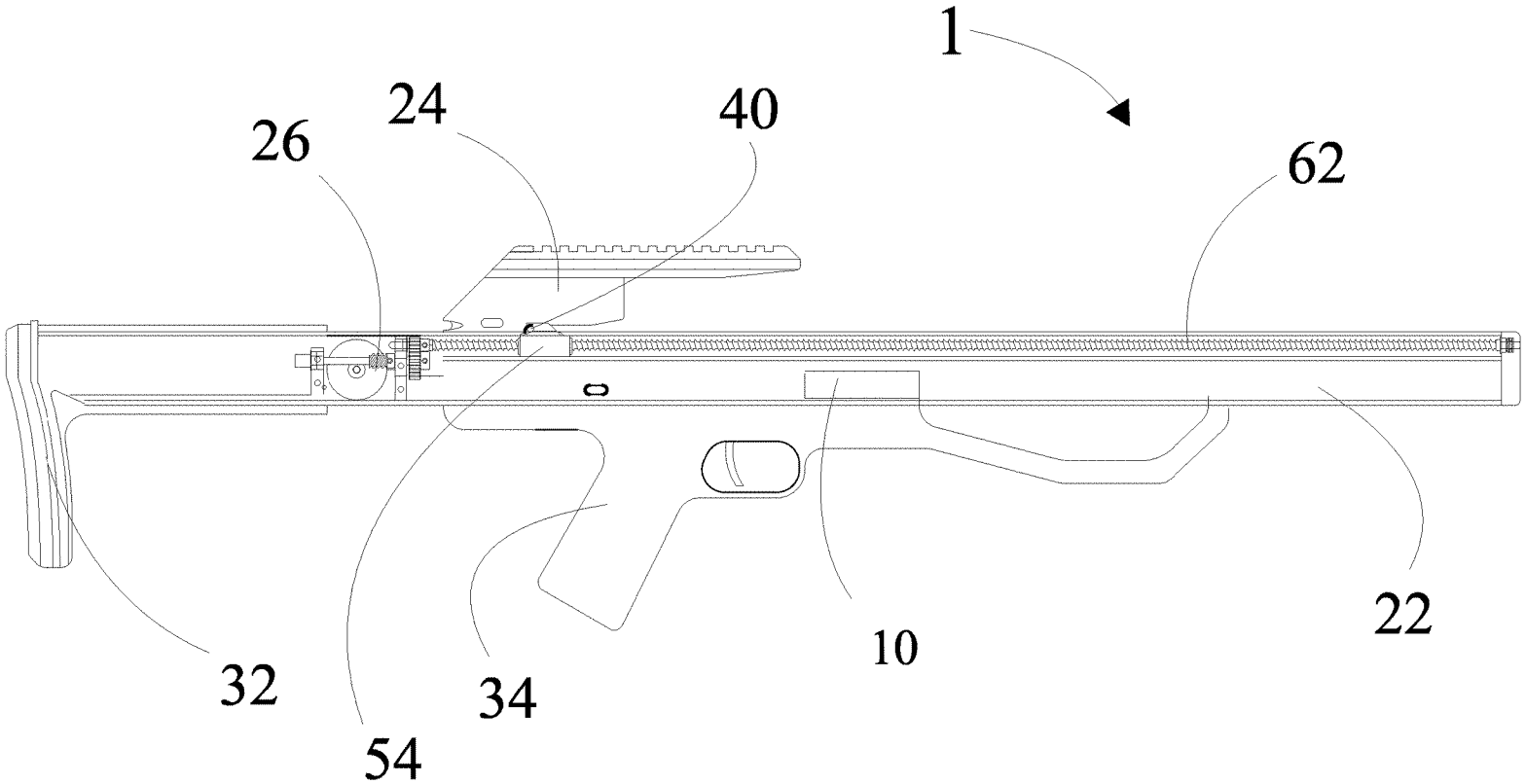
FIG. 3A is a partial cut-away side view of a crossbow with built in cocking device with a motor gearbox assembly in a just-cocked position in accordance with the present invention.
Figure 4:
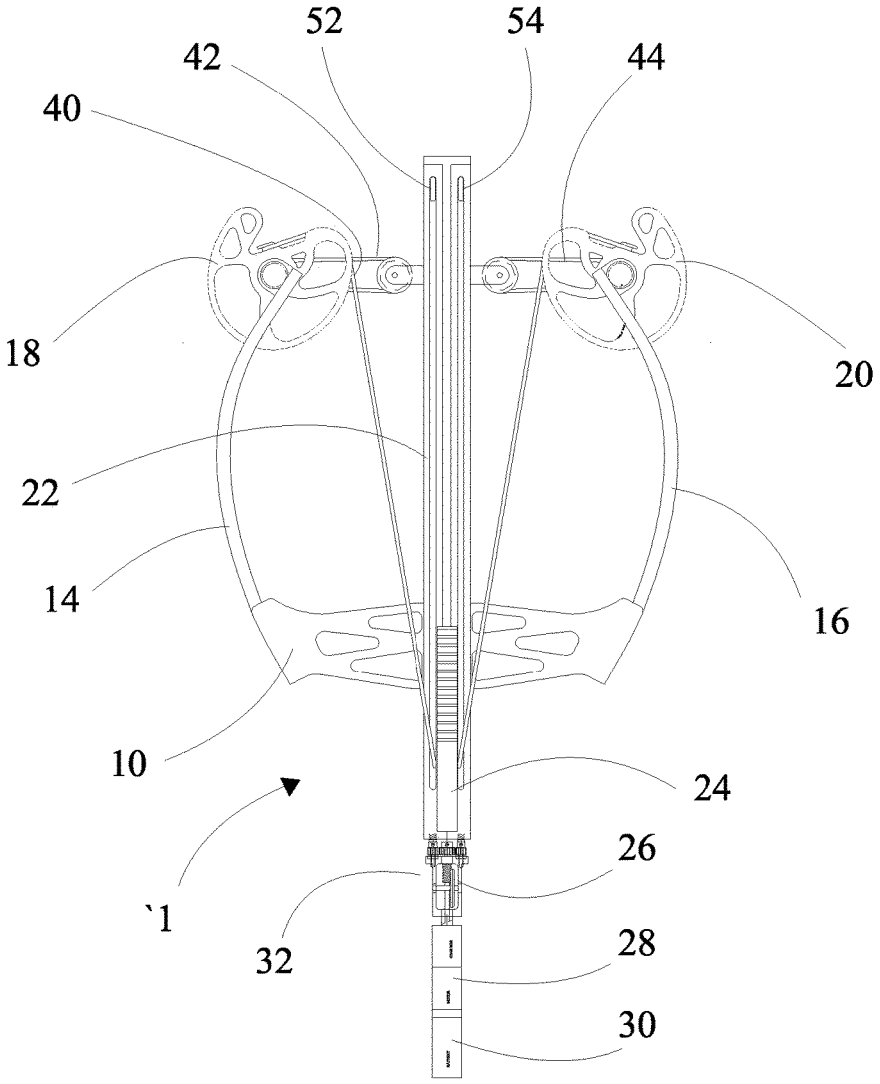
FIG. 4 is a top view of a crossbow with built in cocking device with motor gearbox assembly in a cocked position and carriages in a rest position in accordance with the present invention.
Figure 4A:
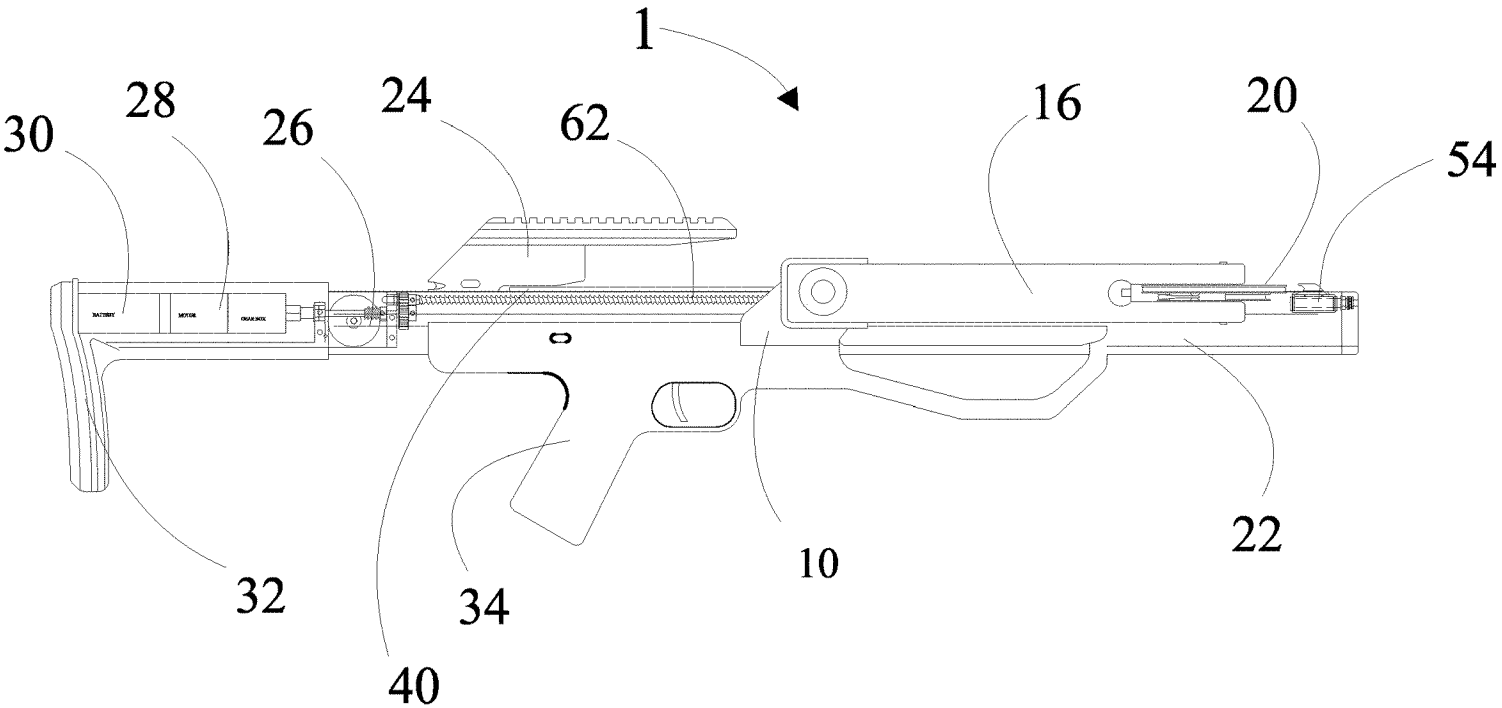
FIG. 4A is a partial cut-away side view of a crossbow with built in cocking device with a motor gearbox assembly in a cocked position, and carriages in a rest position in accordance with the present invention.
Figure 5A:
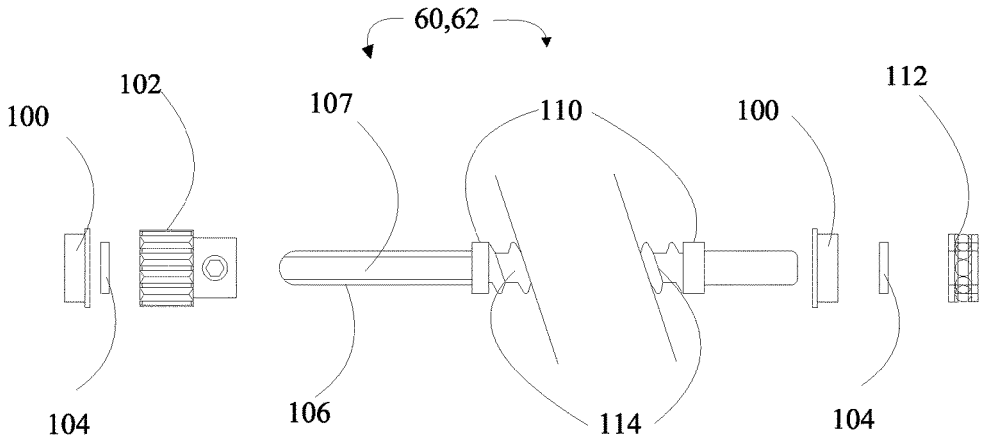
FIG. 5A is an exploded side view of a carriage shaft assembly of a crossbow with built in cocking device in accordance with the present invention.
Figure 5B:
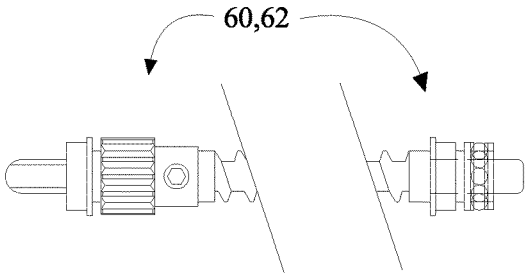
FIG. 5B is an assembled side view of a carriage shaft assembly of a crossbow with built in cocking device in accordance with the present invention.

With reference to FIGS. 5A and 5B, a first carriage shaft assembly 60 is located on a carriage shaft gear mounting surface 107 of a carriage shaft 106 and a second carriage shaft assembly 62 is located on an opposing end of the carriage shaft 106. The carriage shaft 106 also includes threads 114.

The first and second carriage shaft assemblies 60 and 62 include the carriage shaft 106, first and second carriage shaft transition spacers 110, carriage shaft bearings 100, shim spacers 104, a carriage shaft drive gear 102 located at the proximal ends, and a thrust bearing 112 located at the distal ends. With reference to FIGS. 6A and 6B, the crank assembly 26 includes a hand crank drive gear 70, a drive shaft drive gear 72, a drive shaft coupling 74, a drive shaft 76, a drive shaft bearing 78, a hand crank receiver 80, a drive shaft pinion gear 84, a crank assembly front plate 90, a crank assembly rear plate 92, a hand crank gear drive shaft 94, a hand crank drive gear bearing 96, and a drive shaft bearing 98. Carriage shaft bearings 100 are pressed into the crank assembly front plate 90. Proximal ends of the first and second carriage shaft assemblies 60, 62 are inserted into the shaft bearings 100, while indexing the carriage shaft drive gears 102 with the drive shaft drive gear 72.

A first string carriage 52 is joined with the first carriage shaft assembly 60, and a second string carriage 54 is joined with the second carriage shaft assembly 62, creating a combined working assembly 25. The combined working assembly 25 is joined with the barrel or frame 22. A crank handle 108 may be removably and operably coupled with the hand crank receiver 80, or with drive shaft coupling 74. A motor gearbox assembly 28 may be coupled to the drive shaft coupling 74. The motor gearbox assembly 28 preferably includes a built-in clutch assembly, when the rotational force applied by the motor gearbox assembly 28 reaches a predetermined amount of force, the rotation of the drive shaft 76 ceases. The motor gearbox assembly 28 includes a motor and a motor gearbox. The motor gearbox includes a input shaft and an output shaft. A switch 36 may be provided to start, stop, and reverse the direction of rotation of the motor gearbox assembly 28. However, any other device or method known in the art to control operation of the motor gearbox assembly 28 may also be used. The motor gearbox assembly 28 may be removable from the crossbow with cocking 1. A built-in, removable power source 30 may also be integrated with the crossbow 1, and operably joined with motor gearbox assembly 28 and switch 36.

Unique to the disclosed invention is the use of a hand crank drive gear 70 mated to the drive shaft pinion gear 84. The drive shaft 76 is connected to a drive shaft drive gear 72 on a first end, and a drive shaft coupling 74 at a second end. The drive shaft drive gear 72 is operably coupled to the carriage shaft drive gears 102. As the crank handle 108 is turned, rotational forces of the hand crank drive gear 70 turn the drive shaft pinion gear 84, in turn causing rotation of the drive shaft drive gear 72. As the drive shaft drive gear 72 rotates, it causes rotation of the carriage shaft assemblies 60 and 62. At least one internally threaded string carriage 52 is journaled, and an operable component of the carriage shaft assemblies 60. The first and second string carriages 52 and 54 are partially confined by first and second string carriage guide track 51 and 53, preventing the first and second string carriages 52 and 54 from rotating as the shaft threads 114 rotate. Rotation of the shaft threads 114 allow linear movement of the first and second string carriages 52, 54. Rotational movement of carriage shaft threads 114 act as a worm drive or acme thread conveyor. As the carriage shaft threads 114 rotate, the first and second string carriages 52, 54 move forward or backwards, depending on the direction of rotation of the drive shaft 76.

The first and second string carriages 52 and 54 are set at a distal end of the crossbow with cocking 1 when at rest, or when the crossbow with cocking 1 is cocked and ready to shoot. The first and second string carriages 52 and 54 must be returned to the distal end of the crossbow with cocking 1, before the bow string 40 is released. When in use, the crank handle 108 is turned in a first direction, causing the string carriages 52 and 54 to engage the bow string 40, and move the bow string 40 towards a string catch 27. Once the string catch 27 is latched to the bow string 40, the crank handle 108 is rotated in an opposite direction until the string carriages 52 and 54 are in the at-rest position at the distal end of the crossbow 1. The crank handle 108 may be removably and operably coupled with the hand crank receiver 80, or with drive shaft coupling 74.

Another unique feature of the disclosed invention is an optional built-in, removable electric motor gearbox assembly 28 and power source 30 that may be used instead of the crank handle 108 to rotate the drive shaft 76, without removal of the crank assembly 26. The motor gearbox assembly 28 may include an optional clutch assembly, when the rotational force applied by the output shaft of the motor gearbox assembly 28 reaches a predetermined amount of force, the rotation of the drive shaft 76 ceases. A switch 36 may be provided as to start, stop, and reverse the direction of rotation of the output shaft of the motor gearbox assembly 28.

In use, a clutch pack in the motor gear assembly 28 would prevent the first and second string carriages 52 and 54 from traveling past a predetermined forward or rearward position during the cocking and un-cocking procedure. Any method known in the art, such as a micro-switch, limit switch or electronic eye may also be used to control the operation of the motor gearbox assembly 28.

Further unique to the present invention is the ability to de-cock the crossbow 1 without discharging it. The same procedure is used as cocking the crossbow 1. The drive shaft 76 is rotated in a first direction, moving the string carriages 52 and 54 rearwards to engage the string 40. The string catch 27 is disengaged from the string, the drive shaft 76 is rotated in an opposite direction, until the string carriages 52 and 54 reach a rest position at the distal end of the crossbow 1.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention. Such changes may include, but are not limited to, different type of gears, position of gears, power sources, position of power sources, crossbow component construction of multiple elements, multi-element one-piece frame, cam configuration, string and cable configuration, and any other method known in the art of constructing a crossbow.

We claim:

1. A crossbow with built-in cocking device comprising:
- a barrel having a front end and a rear end;
- a riser attached to said barrel;
- a first limb attached to a first end of said riser;
- a second limb attached to a second end of said riser;
- a first cam rotatably retained on said first limb;
- a second cam rotatably retained on said second limb;
- a bow string retained on said first cam and said second cam;
- at least one string carriage for pulling said bow string back toward said rear end;
- a trigger housing retained on said barrel for retaining said bow string in a cocked position; and
- a first carriage shaft, a first slot is formed in a top of said barrel to receive said first carriage shaft, a second carriage shaft, a second slot is formed in said top of said barrel to receive said second carriage shaft, said first and second carriage shafts do not extend above said top of said barrel, said first and second carriage shafts are engaged with one of said at least one string carriage, one end of said first and second carriage shafts extend to substantially said front end, said first and second carriage shafts are located below a top surface of said barrel, wherein said first and second carriage shafts are capable of being rotated with a crank to provide linear motion to one of said at least one string carriage.

2. The crossbow with built-in cocking device of claim 1, further comprising:
- a crank device includes a drive shaft and a hand crank gear drive shaft, a drive shaft pinion gear is retained on said drive shaft, a hand crank drive gear is retained on said hand crank gear drive shaft, wherein rotation of said hand crank gear drive shaft causes said hand crank drive gear to rotate said drive shaft pinion gear, said drive shaft rotates said first and second carriage shafts.

3. The crossbow with built-in cocking device of claim 2, further comprising:
- a crank handle for rotating said hand crank gear drive shaft, said drive shaft or said first and second carriage shafts.

4. The crossbow with built-in cocking device of claim 2, further comprising:
- a drive shaft drive gear is retained on said drive shaft, a carriage shaft drive gear is retained on one of said at least one carriage shaft, wherein rotation of said drive shaft causes said first and second carriage shafts to rotate.

5. A crossbow with built-in cocking device comprising:
- a barrel having a front end and a rear end;
- a riser attached to said barrel;
- a first limb attached to a first end of said riser;
- a second limb attached to a second end of said riser;
- a first cam rotatably retained on said first limb;
- a second cam rotatably retained on said second limb;
- a bow string retained on said first cam and said second cam;
- at least one string carriage for pulling said bow string back toward said rear end;
- a trigger housing retained on said barrel for retaining said bow string in a cocked position;
- a first carriage shaft, a first slot is formed in a top of said barrel to receive said first carriage shaft, a second carriage shaft, a second slot is formed in said top of said barrel to receive said second carriage shaft, said first and second carriage shafts do not extend above said top of said barrel, said first and second carriage shafts are engaged with one of said at least one string carriage, one end of said first and second carriage shafts extend to substantially said front end, said first and second carriage shafts are located below a top surface of said barrel; and
- a motor having a drive shaft which is rotatably coupled to said first and second carriage shafts, wherein said first and second carriage shafts are capable of being rotated with said motor or a crank handle.

6. The crossbow with built-in cocking device of claim 5, further comprising:
- a crank device includes a drive shaft and a hand crank gear drive shaft, a drive shaft pinion gear is retained on said drive shaft, a hand crank drive gear is retained on said hand crank gear drive shaft, wherein rotation of said hand crank gear drive shaft causes said hand crank drive gear to rotate said drive shaft pinion gear, said drive shaft rotates said first and second carriage shafts.

7. The crossbow with built-in cocking device of claim 5, further comprising:
- a crank handle for rotating said hand crank gear drive shaft, said drive shaft rotates said first and second carriage shafts.

8. The crossbow with built-in cocking device of claim 5, further comprising:

a drive shaft drive gear is retained on said drive shaft, a carriage shaft drive gear is retained on one of said at least one carriage shaft, wherein rotation of said drive shaft causes said first and second carriage shafts to rotate.

9. The crossbow with built-in cocking device of claim 5, further comprising:

a battery for supplying electrical power to said motor, said battery is removably retained on said crossbow.

10. The crossbow with built-in cocking device of claim 5 wherein:

a battery for supplying electrical power to said motor is not retained on said crossbow.

11. The crossbow with built-in cocking device of claim 6, further comprising:

a motor gearbox includes an input shaft and an output shaft, said output shaft rotates at a slower speed than said input shaft, a drive shaft of said motor is connected to said input shaft, said output shaft is connected to said drive shaft.

12. A crossbow with built-in cocking device comprising:

a barrel having a front end and a rear end;

a riser attached to said barrel;

a first limb attached to a first end of said riser;

a second limb attached to a second end of said riser;

a first cam rotatably retained on said first limb;

a second cam rotatably retained on said second limb;

a bow string retained on said first cam and said second cam;

at least one string carriage for pulling said bow string back toward said rear end;

a trigger housing retained on said barrel for retaining said bow string in a cocked position;

a first carriage shaft, a first slot is formed in a top of said barrel to receive said first carriage shaft, a second carriage shaft, a second slot is formed in said top of said barrel to receive said second carriage shaft, said first and second carriage shafts do not extend above said top of said barrel, said first and second carriage shafts are engaged with one of said at least one string carriage, one end of said carriage shafts extend to substantially said front end, said first and second carriage shafts are rotatably retained by said barrel, said first and second carriage shafts are located below a top surface of said barrel; and a motor having a drive shaft which is rotatably coupled to said first and second carriage shafts, wherein said first and second carriage shafts are rotated with said motor.

13. The crossbow with built-in cocking device of claim 12, further comprising:

a battery for supplying electrical power to said motor, said battery is removably retained on said crossbow.

14. The crossbow with built-in cocking device of claim 12 wherein:

a battery for supplying electrical power to said motor is not retained on said crossbow.

15. The crossbow with built-in cocking device of claim 12, further comprising:

a motor gearbox includes an input shaft and an output shaft, said output shaft rotates at a slower speed than said input shaft, a drive shaft of said motor is connected to said input shaft, said output shaft is connected to said first and second carriage shafts.

* * * * *